US008640427B2

(12) United States Patent
Briggs, Jr. et al.

(10) Patent No.: US 8,640,427 B2
(45) Date of Patent: Feb. 4, 2014

(54) SOUND INSULATING DOOR

(75) Inventors: Robert Briggs, Jr., Alta Loma, CA (US); Charles J. Kiley, Rancho Cucamonga, CA (US); Brian Hansen, Foothill Ranch, CA (US); Melissa Bishop, Apple Valley, CA (US); Thomas Popow, Palm Springs, CA (US); Mario Moreno, Pico Rivera, CA (US)

(73) Assignee: Door Components, Inc., Fontana, CA (US)

( * ) Notice: Subject to any disclaimer, the term of this patent is extended or adjusted under 35 U.S.C. 154(b) by 5 days.

(21) Appl. No.: 13/436,235

(22) Filed: Mar. 30, 2012

(65) Prior Publication Data

US 2013/0255183 A1 Oct. 3, 2013

(51) Int. Cl.
*E04C 2/54* (2006.01)

(52) U.S. Cl.
USPC ..... 52/784.11; 52/144

(58) Field of Classification Search
USPC ..... 52/782.1, 784.1, 784.11, 784.15, 302.1, 52/302.6, 144, 145
See application file for complete search history.

(56) References Cited

U.S. PATENT DOCUMENTS

| | | | | |
|---|---|---|---|---|
| 1,123,451 | A * | 1/1915 | Wheeler | 52/784.11 |
| 1,183,586 | A * | 5/1916 | Olberg | 52/784.11 |
| 1,931,125 | A | 10/1933 | Balduf | |
| 2,070,219 | A * | 2/1937 | Tracy | 52/784.1 |
| 2,078,207 | A | 4/1937 | Page et al. | |
| 2,459,121 | A | 1/1949 | Willey et al. | |
| 2,880,471 | A * | 4/1959 | Von Munchhausen | 52/404.1 |
| 4,084,367 | A * | 4/1978 | Saylor et al. | 428/113 |
| 4,282,687 | A * | 8/1981 | Teleskivi | 49/503 |
| 4,317,503 | A * | 3/1982 | Soderquist et al. | 181/290 |
| 4,924,969 | A * | 5/1990 | L'Heureux | 181/290 |
| 5,297,369 | A * | 3/1994 | Dickinson | 52/281 |
| 5,561,958 | A * | 10/1996 | Clement et al. | 52/407.1 |
| 5,661,273 | A * | 8/1997 | Bergiadis | 181/290 |
| 6,209,273 | B1 * | 4/2001 | Jeffers et al. | 52/220.7 |
| 6,302,473 | B1 | 10/2001 | Weber | |
| 6,669,553 | B2 | 12/2003 | Adams | |
| 6,688,056 | B2 | 2/2004 | Von Hoyningen Huene et al. | |
| 7,401,847 | B2 | 7/2008 | Kidachi et al. | |
| 7,640,704 | B2 | 1/2010 | Salerno | |
| 8,418,427 | B2 * | 4/2013 | Strickland et al. | 52/742.13 |

FOREIGN PATENT DOCUMENTS

WO WO 2007/132964 A1 11/2007

* cited by examiner

*Primary Examiner* — William Gilbert
*Assistant Examiner* — Gisele Ford
(74) *Attorney, Agent, or Firm* — Christie, Parker & Hale, LLP

(57) ABSTRACT

A door includes a first panel having a plurality of stiffeners thereon; a second panel facing the first panel, the second panel having a plurality of stiffeners thereon facing the stiffeners on the first panel; a first baffle between the first panel and the second panel, the first baffle having a plurality of openings of a first size; and a second baffle adjacent to the first baffle and between the first panel and the second panel, the second baffle having a plurality of openings of a second size different than the first size.

12 Claims, 5 Drawing Sheets

SOUND INSULATING DOOR

FIELD

This application relates generally to doors, and in particular, doors that are designed to be sound insulating.

BACKGROUND

In the provision of so-called soundproof (or sound insulating) structures, it has been the general practice to use one type of construction for fixed walls and another type of construction for doors. However, difficulties have resulted from the doors being far less effective in sound insulation than the fixed walls so that regardless of the sound insulation properties of the wall, much of the efficiency is destroyed by sound transmission through the door.

Another difficulty encountered in connection with sound-insulating door construction results from the fact that some structures, while relatively efficient at preventing the transmission of sound at some frequencies have a poor efficiency at certain particular frequencies.

For many years, the general assumption has been that the control of sound through a barrier, such as a door, is accomplished by absorption. However, doors configured only to absorb sound waves have been found to still allow a significant amount of sound to pass therethrough. More specifically, because sound tends to travel linearly, the sound waves slow down, but still pass through the absorption material and escape through the door.

SUMMARY

According to an embodiment of the present invention, a door is provided including a first panel having a plurality of stiffeners thereon; a second panel facing the first panel, the second panel having a plurality of stiffeners thereon facing the stiffeners on the first panel; a first baffle between the first panel and the second panel, the first baffle having a plurality of openings of a first size; and a second baffle adjacent to the first baffle and between the first panel and the second panel, the second baffle having a plurality of openings of a second size different than the first size.

In one embodiment, the openings on the first baffle are arranged in columns extending across a lateral axis of the first baffle. The openings on the first baffle may be substantially rectangular and a longitudinal axis of the openings may be substantially perpendicular to a longitudinal axis of the first baffle. Moreover, the openings on the second baffle may be arranged in columns extending across a lateral axis of the second baffle.

Similarly, in one embodiment, the openings on the second baffle are substantially rectangular and wherein a longitudinal axis of the openings is substantially perpendicular to a longitudinal axis of the second baffle.

Further, in one embodiment, each of the stiffeners on the first panel and on the second panels includes a pair of feet contacting a surface of the first panel or the second panel, a top spaced from the surface of a respective one of the first panel and the second panel, and a pair of inclined connectors, each of the inclined connectors extending between the top and one of the pair of feet. The stiffeners may be elongate and extend diagonally with respect to a longitudinal axis of the first panel and the second panel.

DETAILED DESCRIPTION

According to embodiments of the present invention, a door 10 is provided having improved sound insulation properties. In general, the door 10 includes a pair of baffles located between a pair of door panels and having a configuration of openings or slots intended to "deaden" sound waves passing through the door, thereby providing effective and efficient sound insulation.

Figure 1:
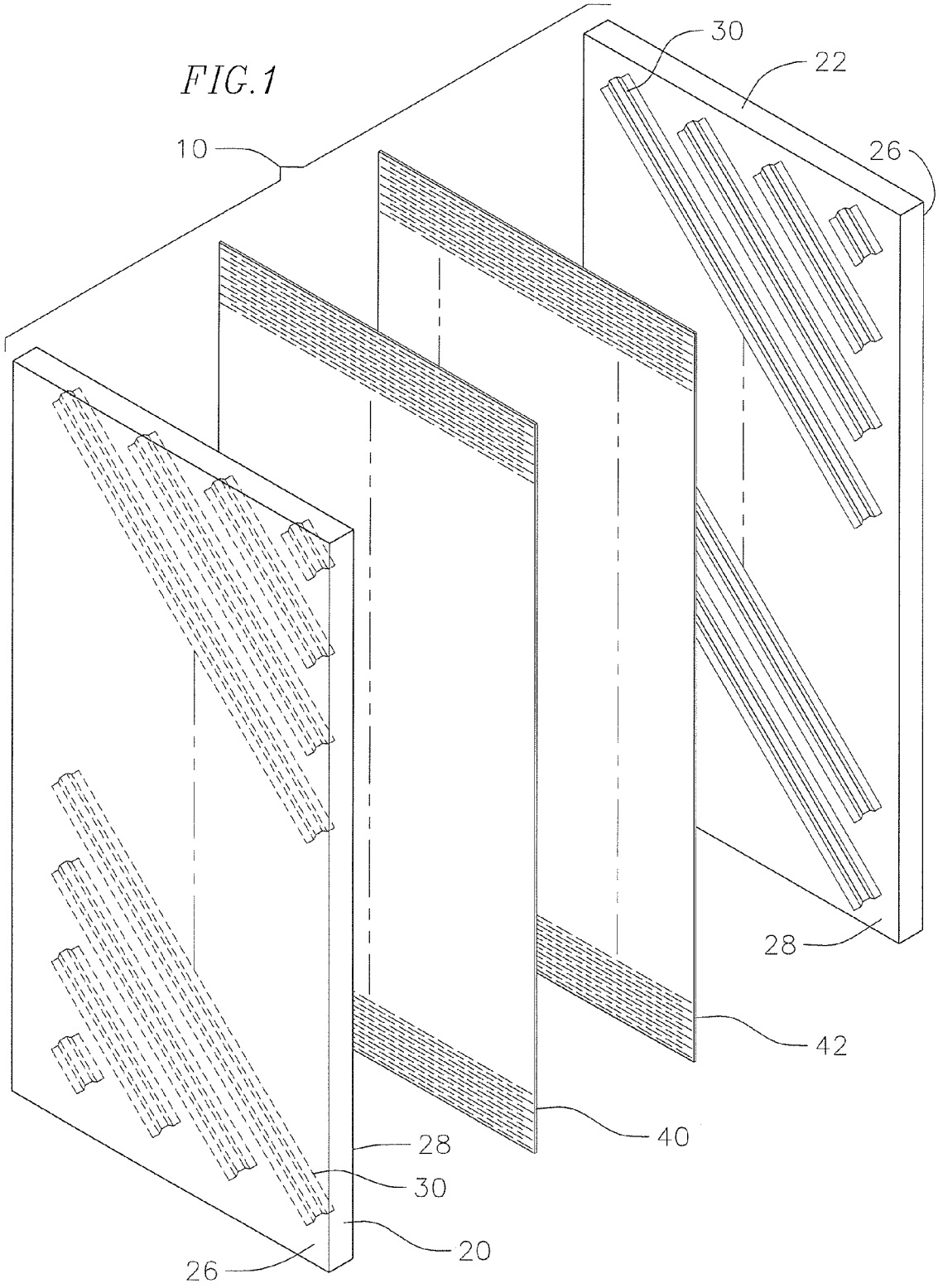
FIG. 1 is a schematic exploded view of an embodiment of a door of the present invention.
Figure 2:
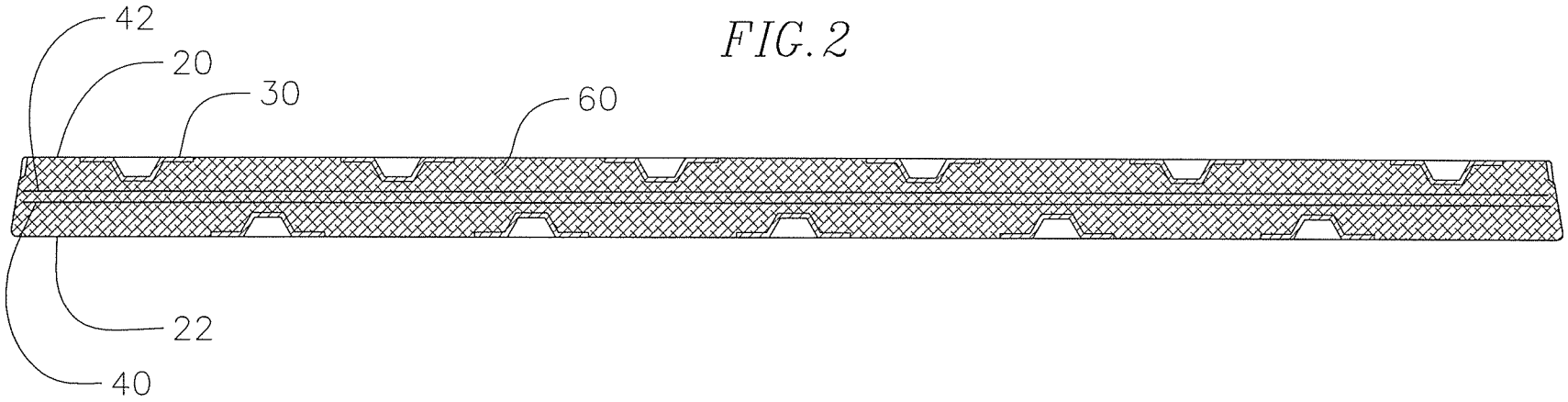
FIG. 2 is cross-sectional view of the door of FIG. 1.

With reference now to FIGS. 1 and 2, the door 10 includes a first panel 20 and a second panel 22 spaced from and opposite to the first panel. The door 10 also includes edges extending between a periphery of the first panel 20 and the second panel 22. The first panel 20 and the second panel 22 form the exterior panels of the door 10 and may also be referred to as the door skin. In embodiments, the first panel 20 and the second panel 22 are made from galvannealed sheet steel ranging from 18 gauge to 14 gauge and may be flat or embossed. However, it will be appreciated that the first and second panels 20, 22 may be made from any suitably rigid material and are not limited to those disclosed specifically herein.

In one embodiment, each of the first panel 20 and the second panel 22 is substantially rectangular and has an external surface 26 and an internal surface 28, wherein the internal surfaces of the panels face each other. In use, a longitudinal axis of the first and second panels 20, 22 extends vertically and a lateral axis extends horizontally. However it will be appreciated that a shape of the door 10 is not limited to the rectangle described herein, but rather that the door may have any suitable shape.

One or both of the panels 20, 22 may include stiffeners 30 attached thereto to maximize the structural integrity of the door 10 and to further provide sound insulation. In one embodiment, the stiffeners 30 are elongate members that extend along a portion of the interior surface 28 of one of the panels 20, 22.

Figure 3:
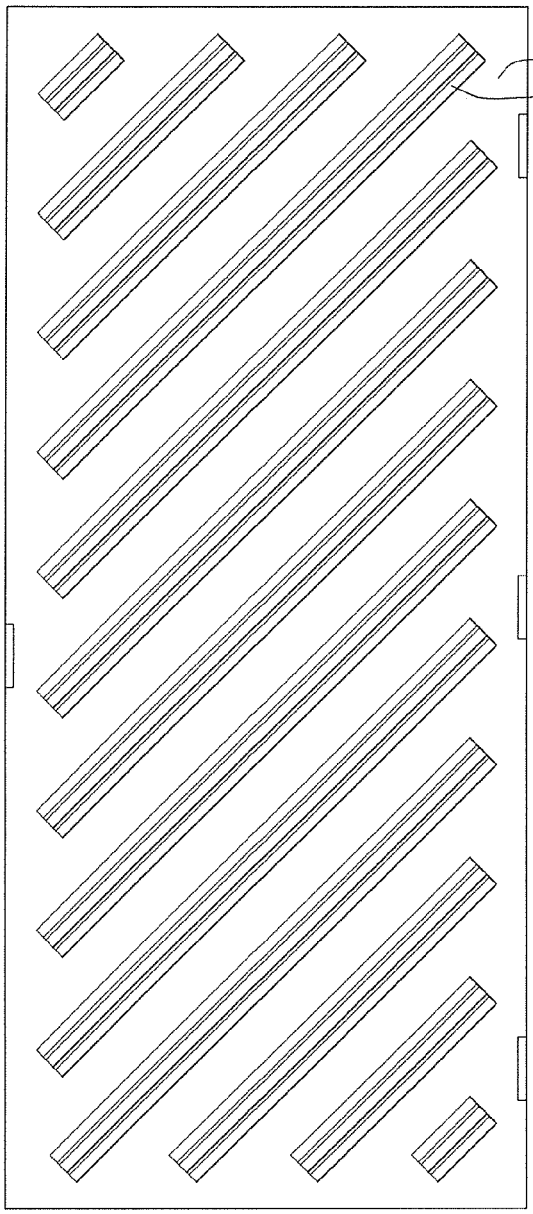
FIG. 3 is a front view of a first panel of the door of FIG. 2.

With reference now also to FIG. 3, the first panel 20 includes thirteen stiffeners 30 that are oriented such that a longitudinal axis of each stiffener 30 extends generally diagonally on the internal surface 28 with respect to the longitudinal axis of the panel. Additionally, all of the stiffeners 30 on the first panel 20 are oriented to extend substantially parallel to each other. Due to their diagonal orientation, the stiffeners 30 disperse sound to the outer more rigid rails of the door 10 rather than moving the sound vertically to the top and bottom edges of the door where it can more easily escape. In one embodiment, the stiffeners 30 are angled at about 45 degrees from the horizontal, but it will be understood that the stiffeners could be oriented at other angles as well. Additionally, it will be appreciated that although the stiffeners 30 have been described as being diagonally oriented in one embodiment, the stiffeners 30 may also be oriented vertically or horizontally within the scope and spirit of the invention.

Figure 5:
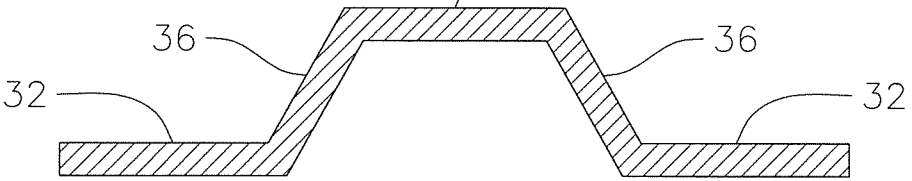
FIG. 5 is a cross-sectional view of a stiffener of the door of FIG. 1.

With reference now to FIG. 5, a cross-sectional view of the stiffener 30 is shown. The stiffener 30 includes a pair of feet 32, a top 34, and a pair of inclined connectors 36 extending between each foot and the top. In one embodiment, the feet 32 are substantially flat and substantially parallel to the internal surface 28 of the first panel 20 and the second panel 22. Accordingly, the feet 32 provide a sufficient surface for coupling the stiffeners 30 to each panel 20, 22, such as by welding or by a fastener, for example, an adhesive, a nut and bolt, a rivet, or a screw. However, it will be appreciated that the stiffeners 30 can be attached to the panels 20, 22 by any structure able to sufficiently secure them to the panels.

The inclined connectors 34 extend from a respective foot 32 at an oblique angle. Although the specific angle is not critical, in one embodiment, the inclined connectors 36 extend at between about 110 degrees and about 125 degrees. The top 34 extends between the pair of inclined connectors 36 in a direction substantially parallel to the feet 32. Accordingly, the stiffener 30 has a cross-sectional "mesa" or flat-top pyramid shape. In one embodiment, a height of the stiffener 30 is less than a thickness of the respective panel 20, 22 to which it is attached and its corresponding edge such that a height of a stiffener on one of the panels does not overlap with the height of a stiffener on the other panel. Specifically in one embodiment, the stiffener 30 has a height of between about 0.25 inch and about 0.75 inch, but it will be appreciated that the height is not limited thereto.

The stiffener 30 may be made from a single integral piece of galvannealed sheet steel, for example, between 12 gauge and 20 gauge sheet steel, but it will be appreciated that the stiffener 30 may be made from any sufficiently rigid material and may be made from separate components coupled together rather than being integral.

Figure 4:
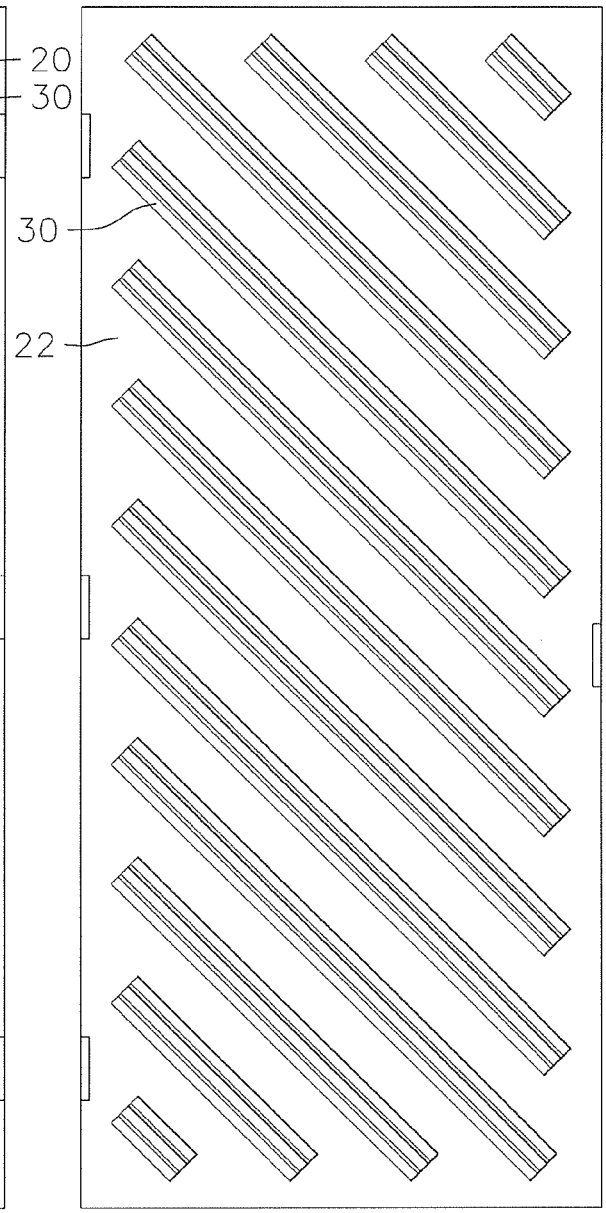
FIG. 4 is a front view of a second panel of the door of FIG. 2.

With reference now to FIG. 4, the second panel 22 also includes a plurality of stiffeners 30 having substantially the same configuration as those described with respect to the first panel 20 (FIG. 3). As shown in the figure, the stiffeners 30 on the second panel 22 are also on the interior surface 28 and are oriented such that their longitudinal axis extends diagonally with respect to the longitudinal axis of the panel. However, the stiffeners 30 on the second panel 22 are oriented opposite to the stiffeners on the first panel 20 such that when the interior surfaces 28 of the first panel and the second panel 22 face each other, the stiffeners extend substantially parallel to each other. Additionally, the stiffeners 30 on the second panel 22 are spaced to occupy a space between adjacent stiffeners 30 on the first panel (FIG. 2) such that the stiffeners on the first second panels 20, 22 alternate along the door 10.

Figure 6:
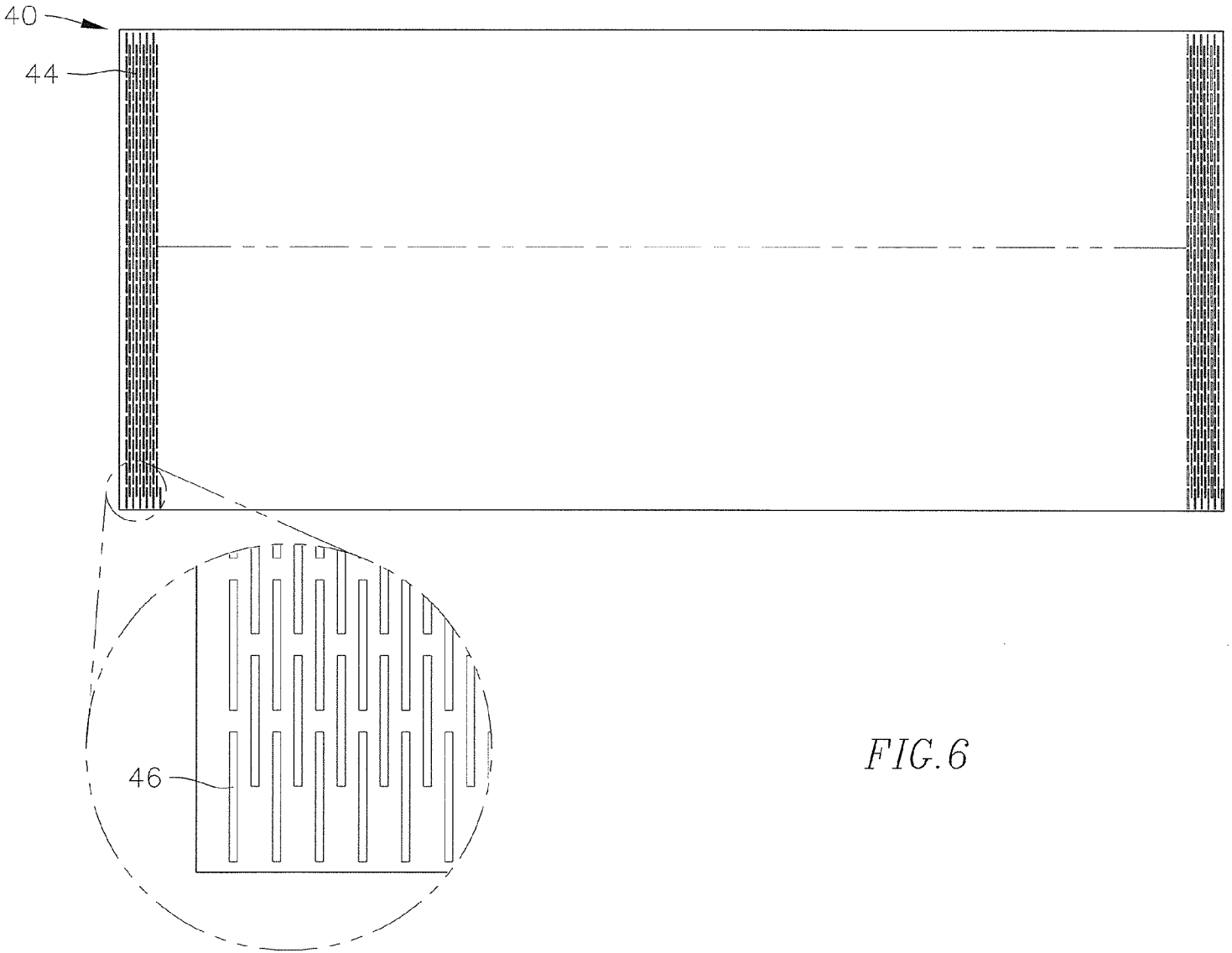
FIG. 6 is a front view of a short slot baffle of the door of FIG. 1.
Figure 7:
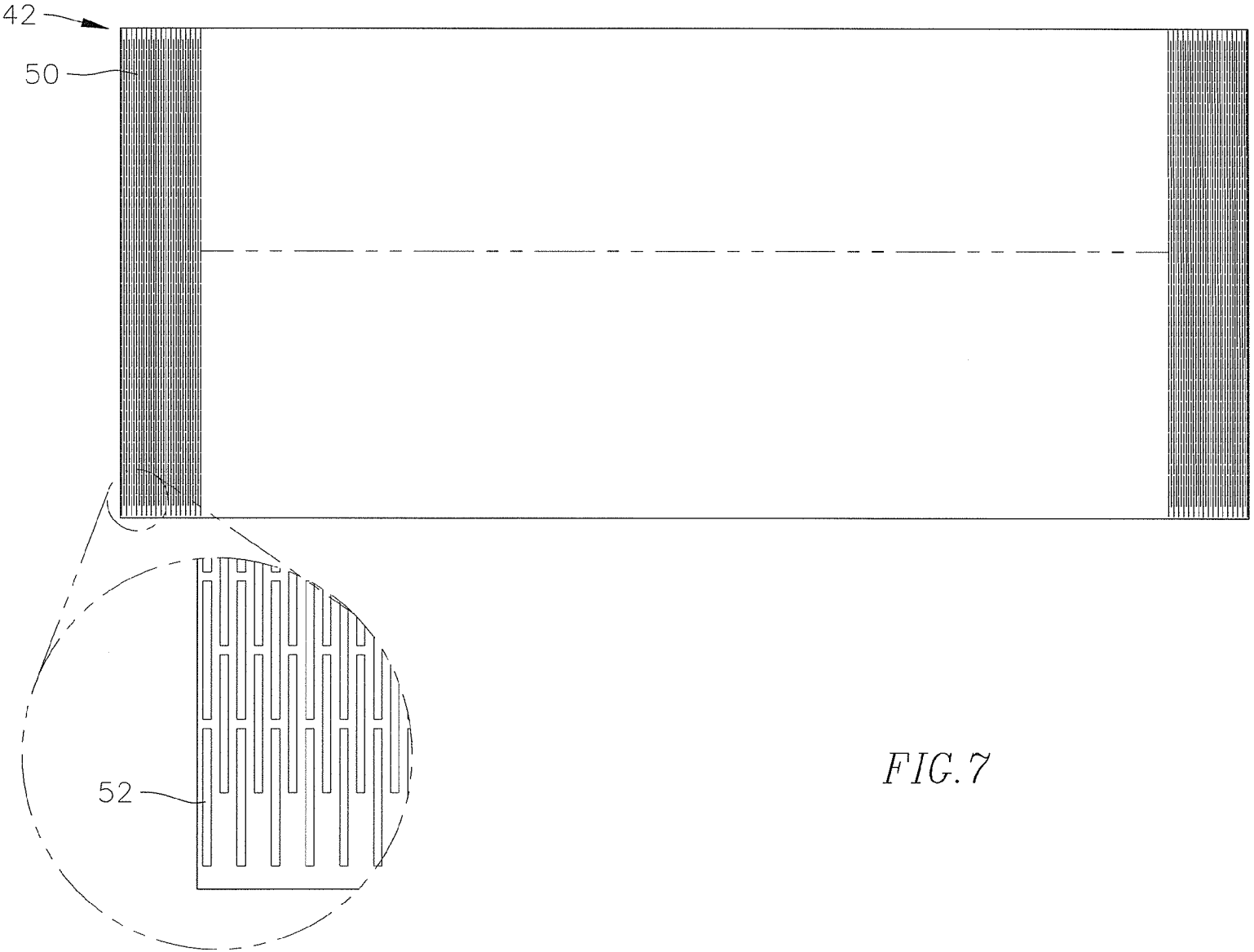
FIG. 7 is a front view of a long slot baffle of the door of FIG. 1.

With reference now to FIGS. 6 and 7, the door 10 includes a pair of baffles 40, 42 located between the first panel 20 and the second panel 22 (FIG. 2). More specifically, the baffles 40, 42 are sized to have substantially the same size as the panels 20, 22 and serve to deaden sound waves within the door 10. In one embodiment, the door 10 includes a short slot baffle 40 and a long slot baffle 42.

As shown in FIG. 6, the short slot baffle 40 includes a generally rigid and planar rectangular body 44 having a longitudinal axis extending in a first direction, for example, in a vertical direction when the door 10 is installed. Additionally, the short slot baffle 40 includes a plurality of openings or slots 46 arranged in columns 48 that extend in a second direction along a lateral axis substantially perpendicular to the longitudinal axis of the body 44. Further, a longitudinal axis of each of the slots 46 extends parallel to the columns 48 of slots and therefore substantially perpendicular to the longitudinal axis of the body 44. In one embodiment, a length of the slots 46 is between about 1.4 inches and about 1.6 inches and a width of the slots is between about 0.04 inch and about 0.14 inch. Further, in one embodiment, adjacent slots 46 in the same column 48 are spaced between about 0.2 inch and about 0.3 inch apart and the distance between a centerline of adjacent slots in adjacent columns is also between about 0.2 inch and about 0.3 inch apart. As shown in FIG. 6, the slots 46 in adjacent columns 48 are staggered such that a slot in a first column overlaps the space between adjacent slots in a second column adjacent to the first column.

As shown in FIG. 7, the long slot baffle 42 is similar to the short slot baffle 40 and includes a generally rigid and planar rectangular body 50 having a longitudinal axis extending in a first direction, for example, in a vertical direction when the door 10 is installed. Additionally, the long slot baffle 42 includes a plurality of openings or slots 52 arranged in columns 54 that extend in a second direction along a lateral axis substantially perpendicular to the longitudinal axis of the body 50. Further, a longitudinal axis of each of the slots 52 extends parallel to the columns 54 of slots and therefore substantially perpendicular to the longitudinal axis of the body 50. In one embodiment, a length of the slots 52 is between about 3.9 inches and about 4.1 inches and a width of the slots is between about 0.2 inch and about 0.3 inch. Further, in one embodiment, adjacent slots 52 in the same column 54 are spaced between about 0.2 inch and about 0.3 inch apart and the distance between a centerline of adjacent slots in adjacent columns is between about 0.4 inch and about 0.6 inch apart. As shown in FIG. 7, the slots 52 in adjacent columns 54 are staggered such that a slot in a first column overlaps the space between adjacent slots in a second column adjacent to the first column.

The slotted baffles 40, 42 improve sound insulation by confusing the sound. More specifically, each slot is tuned to a certain general frequency which bounces the sound within and through the baffling system, thereby significantly minimizing the ability for sound waves to escape from the door.

An insulation material 60, such as a fiber glass matting, is located between the first panel 20 and the second panel 22 including, in one embodiment, between the baffles 40, 42, for sound insulation purposes.

One embodiment of assembly of the door 10 will now be described. The first and second panels 20, 22 are formed from two faces that are punched into a pan assembly form. Each pan assembly receives the stiffeners 30 which may be taped or otherwise secured to the pan assemblies. After the stiffeners 30 are attached, the fiberglass matting 60 is inserted between the two panels 20, 22 and one, two, or more baffles 40, 42 are inserted between the panels. Additional fiberglass matting 60 may also be inserted between adjacent baffles. The halves are then joined and seam welded continuously to seal them together.

While this invention has been particularly shown and described with reference to preferred embodiments thereof, it will be understood by those skilled in the art that various changes in form and details may be made therein without departing from the spirit and scope of the invention as defined by the appended claims. The embodiments should be considered in descriptive sense only and not for purposes of limitation. Therefore, the scope of the invention is defined not by the detailed description of the invention but by the appended claims, and all differences within the scope will be construed as being included in the present invention.

What is claimed is:

1. A door comprising:

a first panel having a plurality of stiffeners thereon;

a second panel facing the first panel, the second panel having a plurality of stiffeners thereon facing the stiffeners on the first panel;

a first baffle between the first panel and the second panel, the first baffle having a plurality of longitudinal slots of a first size, the longitudinal slots being substantially perpendicular to a longitudinal axis of the first baffle.

2. The door of claim 1, wherein the longitudinal slots on the first baffle are arranged in columns extending across a lateral axis of the first baffle.

3. The door of claim 1, wherein the longitudinal slots on the first baffle are substantially rectangular.

4. The door of claim 1, further comprising a second baffle adjacent to the first baffle and between the first panel and the second panel, the second baffle having a plurality of longitudinal slots of a second size different than the first size, the longitudinal slots being substantially perpendicular to a longitudinal axis of the second baffle.

5. The door of claim 4, wherein the longitudinal slots on the second baffle are arranged in columns extending across a lateral axis of the second baffle.

6. The door of claim 5, wherein the longitudinal slots on the second baffle are substantially rectangular.

7. The door of claim 2, wherein each of the stiffeners on the first panel and on the second panel comprises a pair of feet contacting a surface of the first panel or the second panel and a top spaced from the surface of a respective one of the first panel and the second panel.

8. The door of claim 7, wherein the stiffeners each further comprises a pair of inclined connectors, each of the inclined connectors extending between the top and one of the pair of feet.

9. The door of claim 2, wherein the stiffeners are elongate and extend diagonally with respect to a longitudinal axis of the first panel and the second panel.

10. The door of claim 1, wherein the stiffeners on the first panel are substantially parallel to the stiffeners on the second panel.

11. The door of claim 1, wherein a length of the longitudinal slot on the first baffle is about 1.5 inches.

12. The door of claim 2, wherein a length of the longitudinal slot on the second baffle is about 4 inches.

* * * * *